United States Patent [19]

Brunner et al.

[11] Patent Number: 4,606,486

[45] Date of Patent: Aug. 19, 1986

[54] TILT-BOX CONTROL SYSTEM

[75] Inventors: Gerhard Brunner, Augsburg; Arnold Sigel, Streitheim; Margrit Scharschinger, Augsburg, all of Fed. Rep. of Germany

[73] Assignee: Erhardt & Leimer GmbH, Augsburg, Fed. Rep. of Germany

[21] Appl. No.: 545,745

[22] Filed: Oct. 26, 1983

[30] Foreign Application Priority Data

Oct. 26, 1982 [DE] Fed. Rep. of Germany ..... 3239565

[51] Int. Cl.[4] ..... B65H 23/038

[52] U.S. Cl. ..... 226/19; 226/21

[58] Field of Search ..... 226/3, 18, 19, 20, 21, 226/22, 23, 45, 180; 198/840, 842; 474/102, 103, 104

[56] References Cited

U.S. PATENT DOCUMENTS

| | | | |
|---|---|---|---|
| 2,536,559 | 1/1951 | Lewis | 474/103 |
| 2,792,504 | 5/1957 | Slamar et al. | 226/21 X |
| 2,842,361 | 7/1958 | Miller | 226/21 |
| 2,940,752 | 6/1960 | Deeken | 226/180 |
| 3,019,955 | 2/1962 | Walthall | 226/21 |
| 3,373,288 | 3/1968 | Otepka et al. | 226/21 X |
| 3,390,823 | 7/1968 | Ott, Jr. | 226/19 |
| 3,581,963 | 6/1971 | Rule | 226/21 X |
| 3,591,064 | 7/1971 | Wyatt et al. | 226/22 |
| 3,621,987 | 11/1971 | Sherwood | 226/21 X |
| 3,693,781 | 9/1972 | Homeier | 226/23 X |
| 3,820,888 | 6/1974 | Jordon | 226/23 X |
| 4,049,213 | 9/1977 | Hank et al. | 226/19 X |
| 4,095,733 | 6/1978 | Scribner | 226/162 |
| 4,342,412 | 8/1982 | Lorenz et al. | 226/21 |

*Primary Examiner*—Harvey C. Hornsby
*Assistant Examiner*—Scott J. Haugland
*Attorney, Agent, or Firm*—Karl F. Ross; Herbert Dubno

[57] ABSTRACT

A control system is used in combination with a tilt-box arrangement for controlling the transverse displacement of a web and having a stationary support frame and a roller frame pivotal on the support frame about a frame axis and carrying at least one roller rotatable about a roller axis transverse to the frame axis. The web is engaged over the roller and moves in a transport direction transverse to the frame axis and to the roller axis. A drive is connected between the support and roller frames and operates to pivotally displace the roller frame in opposite angular directions from a center position with the roll axis perpendicular to the transport direction toward respective end positions and thereby laterally deflect the web engaged by the roller. The system comprises a sensor holder provided on one of the frames and having two respective end-position sensors and a center-position sensor, a stop holder provided on the other frame and having respective end-position and center-position stops juxtaposable and cooperating with the respective sensors in the respective positions of the roller frame on the support frame, and a controller connected between the sensors and the drive for operating the drive in accordance with the frame position detected by the sensors.

7 Claims, 9 Drawing Figures

TILT-BOX CONTROL SYSTEM

FIELD OF THE INVENTION

The present invention relates to a tilt box of the type used to laterally guide a web workpiece in a production line. More particularly this invention concerns a system for controlling the angular position of such a box.

BACKGROUND OF THE INVENTION

A tilt box such as described in U.S. Pat. No. 4,342,412 is provided with rollers that rotate about respective axes normally perpendicular to the displacement direction of a continuously moving web passing over them. These rollers are carried on a frame pivotal about an axis perpendicular to the workpiece travel direction. When the web moves to one side or the other, that is crosswise of the displacement direction, the roller frame is pivoted appropriately to bring it back onto center. As the web is fed into the system it is often necessary to apply quite a bit of correction, before the production line is completely up.

Downstream of the tilt box at least one position sensor detects the transverse position of the web and feeds an appropriate output to a controller which is connected to a drive that can pivot the roller frame. The controller therefore adjusts, in a standard feedback-type system, the frame position by means of the drive in accordance with the detected web position. When the web is initially fed through the tilt box, same is normally centered, as the downstream sensor is only effective once the workpiece is loaded all through the line.

Typically the frame itself is provided with various position detectors. One establishes the above-mentioned center position and serves mainly when a new web workpiece is being threaded through the tilt-box rollers. Two others are positioned when the frame is in extreme end positions, and serve normally to shut down the system since in these extreme end positions further overtravel and tearing of the web is likely. Two further position detectors respond as the frame approaches the respective extreme end positions and normally are hooked up to sound an alarm so the machine operator can check what is happening and correct it, if possible without having to shut down the line.

This complex of position detectors is normally constituted as individual switches and actuators that are positioned all over the pivotal roller frame and its support. They are difficult to install and adjust, and are a clutter of wire that makes working on the machine fairly troublesome.

OBJECTS OF THE INVENTION

It is therefore an object of the present invention to provide an improved tilt-box control system.

Another object is the provision of such a tilt-box control system which overcomes the above-given disadvantages, that is which is relatively simple and easy to service.

SUMMARY OF THE INVENTION

The control system according to this invention is used in combination with a tilt-box arrangement for controlling the transverse displacement of a web and having a stationary support frame and a roller frame pivotal on the support frame about a frame axis and carrying at least one roller rotatable about a roller axis transverse to the frame axis. The web is engaged over the roller and moves in a transport direction transverse to the frame axis and to the roller axis. A drive is connected between the support and roller frames and operates to pivotally displace the roller frame in opposite angular directions from a center position with the roll axis perpendicular to the transport direction toward respective end positions and thereby laterally deflect the web engaged by the roller. The system comprises a sensor holder provided on one of the frames and having two respective end-position sensors and a center-position sensor, a stop holder provided on the other frame and having respective end-position and center-position stops juxtaposable and cooperating with the sensors in the respective positions of the roller frame on the support frame, and a controller connected between the sensors and the drive for operating the drive in accordance with the frame position detected by the sensors.

The two holders can be mounted in convenient locations on the apparatus so that they can be completely out of the way. Putting them all together makes installing and repairing them very easy, and greatly reduces likelihood of failure by protecting them together. The holders can be replaced entirely relatively easily, and can be calibrated at the factory.

According to this invention the sensor holder is carried on the support frame and the sensors project generally in the transport direction therefrom. In addition means is provided for securing each of the stops on the stop holder in any of a plurality of different positions thereon. The control system can therefore be easily adjusted.

In accordance with another feature of this invention the center-position sensor is a proximity switch and the end-position sensors are switches vertically offset from the center-position sensor. In this manner it is possible to group them very closely. In addition a second pair of end-position sensors and stops lying at least partially just within the first-mentioned pair of end-position sensors and stops on the respective holders can be provided as near-end position detectors.

The support frame according to this invention carries a beam constituting the stop holder. The drive includes a threaded spindle generally fixed on the support frame and extending transversely of the travel direction and frame axis and a nut on the spindle and generally fixed on the roller frame. Thus relative rotation of the spindle and nut angularly displaces the roller frame on the support frame. The stops are carried on the spindle and the sensor holder is provided with the nut. In this arrangement the sensor holder is a box containing the sensors and the control unit includes a cable connected through the box to the sensors. The spindle itself is provided with a switch-actuating element constituting the stops. This element is of a synthetic resin and is a symmetrical body of revolution centered on the spindle.

The sensor holder of this invention is provided with a circuit board carrying the sensors which project from the holder toward the stop holder. The stop holder is a rail extending transversely of the transport direction and respective loosenable securing means hold the stops on the rail at any of a plurality of positions offset therealong. These securing means each include a nut block riding in the rail and a bolt threaded into the nut and extending through the respective stop. At least some of the stops are pivotal on the respective screws and clampable in positions engageable and unengageable with the respective sensors. This allows the apparatus to be set up for very accurate operation of the various switches.

The end-position stops are offset parallel to the frame axis from the center-position stop. The second pair of end-position sensors and stops lying in part just within the first-mentioned pair of end-position sensors and stops on the respective holders are vertically offset from the first-mentioned end-position sensors.

DESCRIPTION OF THE DRAWING

The above and other features and advantages will become more readily apparent from the following, reference being made to the accompanying drawing in which.

SPECIFIC DESCRIPTION

Figure 1:
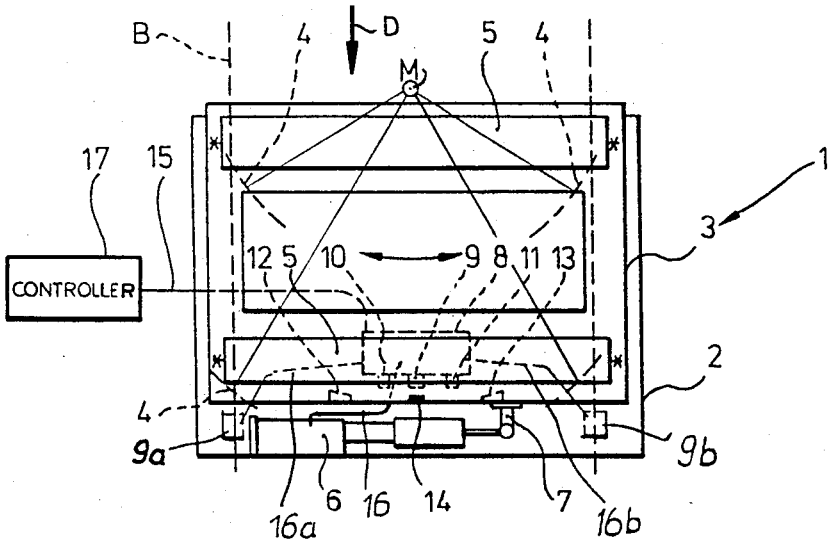
FIG. 1 is a partly schematic top view of the tilt-box arrangement according to this invention.
Figure 2:
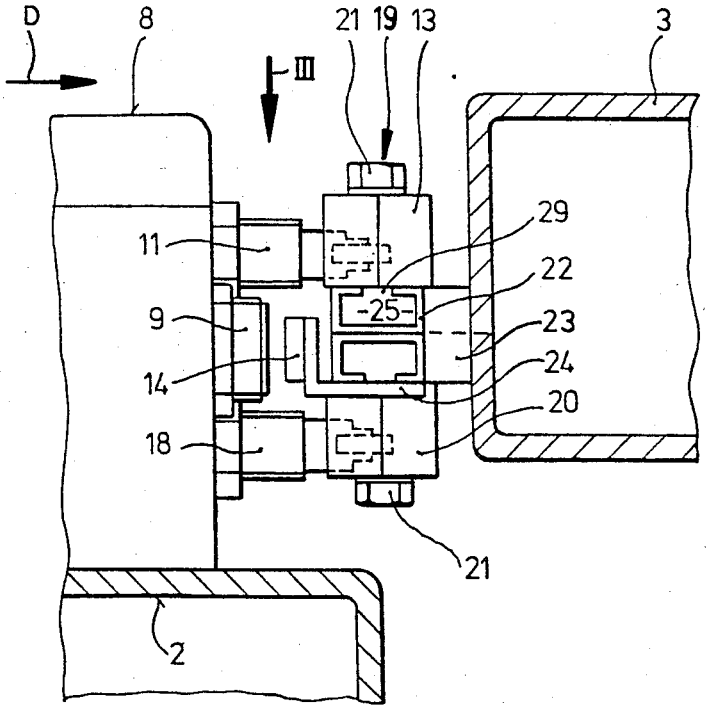
FIG. 2 is a large-scale vertical section through a detail of FIG. 1.

As seen in FIGS. 1 through 6, the tilt-box arrangement 1 according to this invention basically comprises a support frame or base 2 and a roller frame 3. Rollers such as described in the above-cited patent support the frame 3 on arcuate rails 4 on the base 2 for pivoting of the frame 3 about a vertical axis M that itself extends transverse to the normal displacement direction D of a workpiece web B. The roller frame 3 carries two rollers 5 rotatable about parallel axes lying in a horizontal plane transverse to the axis M. The web B passes over one of the rollers 5 and under the other roller 5.

A drive 6, which may be a hydraulic cylinder or a hydraulic or electric motor, is fixed on the base 2 and is connected at 7 to the roller frame 3. This drive 6 can therefore pivotally displace the frame 3 on the base 2 about the axis M in accordance with the position of the web B transverse to the direction D downstream in this direction D from the tilt box 1.

As described in the above-mentioned patent, when the web B wanders laterally in one direction, for instance toward the right as seen in FIG. 1, a controller 17 connected via cables 15, 16*a*, and 16*b* to downstream position sensors 9*a* and 9*b* operates the drive 6 to pivot the frame 3 slightly clockwise. Thus the rollers 5 do not extend perfectly perpendicular of the direction D and the web B is returned to the desired position. Under normal conditions, however, the frame 3 is in the illustrated center position with the rolls 5 perfectly perpendicular to the travel direction D. The frame 3 can move angularly in either direction from this centered position to two respective end positions.

Figure 5:
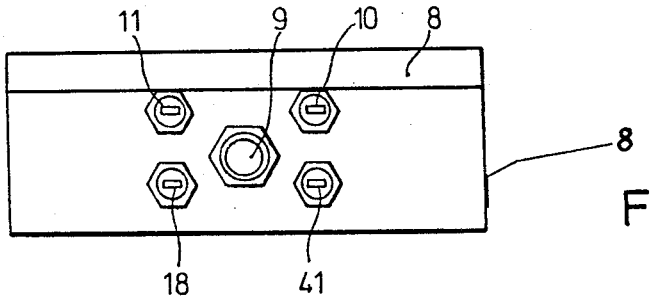
FIGS. 5 and 6 are small-scale front and top views of a detail of the control system of this invention.
Figure 6:
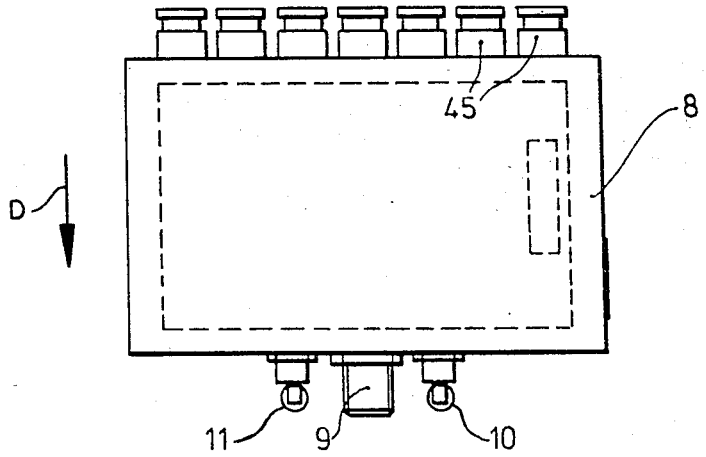

According to this invention the base 2 as best seen in FIGS. 5 and 6 is provided with a holder or box 8 housing a center-position sensor or detector switch 9, two far-end sensor switches 10 and 11, and two near-end sensor switches 18 and 41. The switches 10 and 11 are located horizontally spaced from each other above the sensor 9 and switches 18 and 41, but horizontally level with each other. Similarly the switches 18 and 41 are spaced horizontally from each other and both lie in a common plane below the respective upper switches 11 and 10 and also below the sensor 9. The switches 10, 11, 18, and 41 are of the depressible roller type.

The support frame 3 has an actuator unit 19 constituted by a projection 23 on the frame 3 carrying a pair of vertically open back-to-back C-section rails 22 on which are mounted various stops 12, 13, and 20 that can actuate the switches 10, 11, 18, and 41. The stops 12 and 13 for the switches 10 and 11 are horizontally spaced from each other and lie above the stops 20 for the switches 28 and 41.

Figure 3:
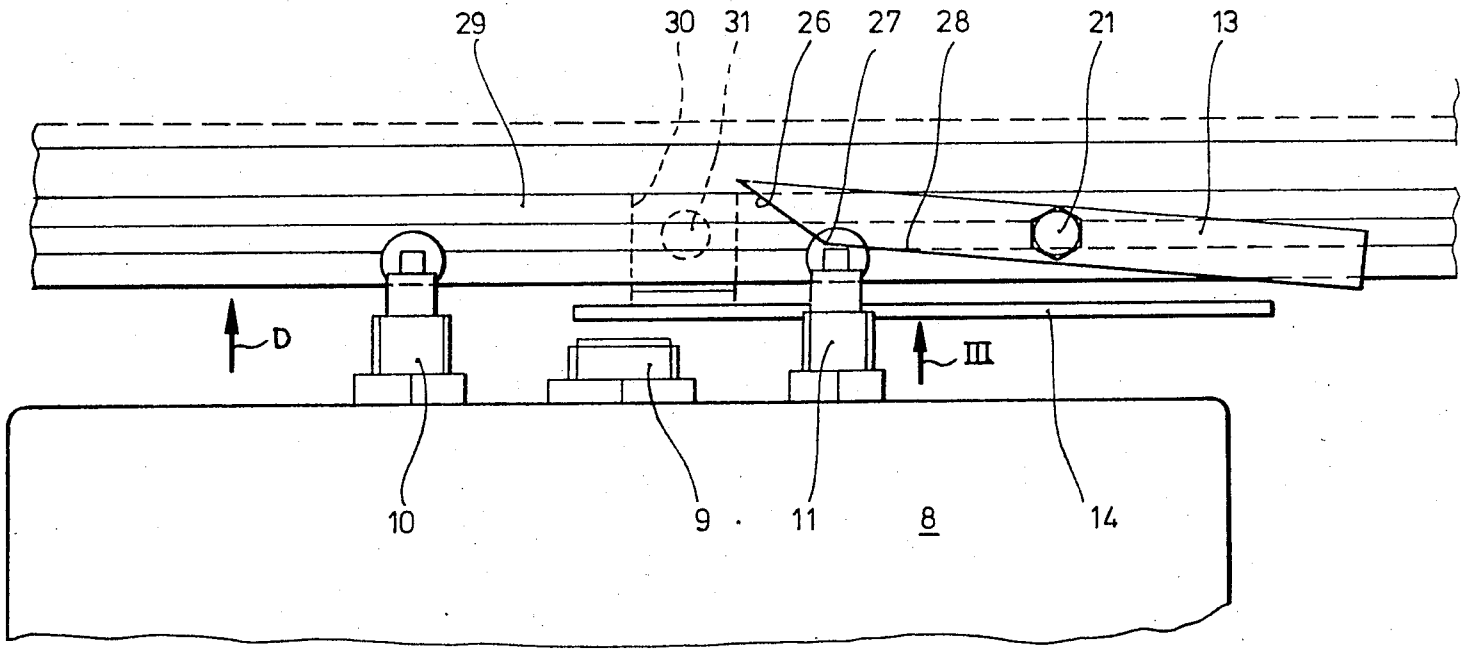
FIG. 3 is a top view taken in the direction of arrow III of FIG. 2.
Figure 4:
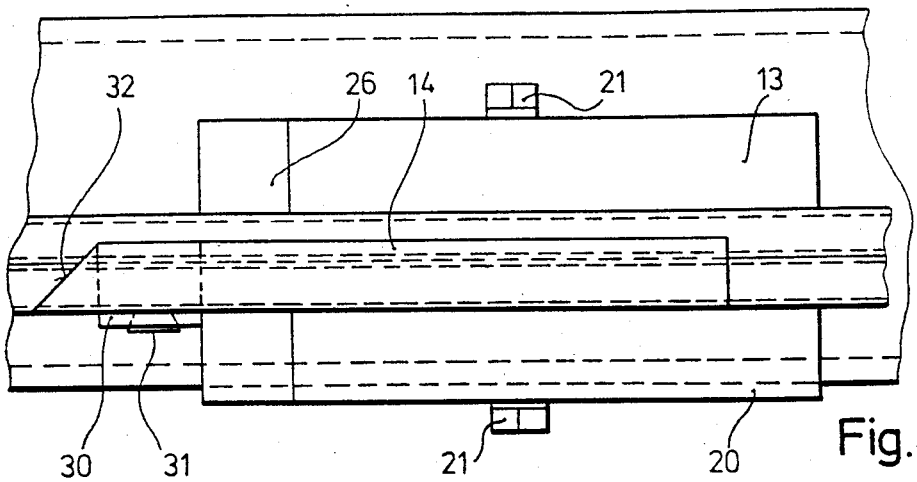
FIG. 4 is a side view taken in the direction of arrow IV of FIG. 3.

FIG. 3 shows the stop 13, which is identical to the stops 12 and 20. It is a bar centrally traversed by a bolt 21 extending through a slot 29 of the respective rail 22 into the threaded bore of a nut block 25 (FIG. 2) displaceable along this rail 22. The stop bar 13 is of rectangular section and has one end surface extending at about 30° to its longitudinal axis and joining at a corner 27 with a side edge 28. The edge 27 is adjusted to engage and actuate the switch 11 just when the frame 3 moves into the respective far-end position. Similarly the edge 27 of the stop 12 is set to act on the switch 20 in the opposite far-end positions, and the stops 20 are set to close the respective switches 18 and 41 when the frame moves into the respective near-end positions, that is almost into the far-end positions.

The sensor 9 vertically flanked by the switches 10 and 11 on one side and the switches 18 and 41 on the other cooperates with a stop or actuator 14 carried on an L-shaped bracket 24 secured by a screw 31 to a nut block 30 (FIG. 3) slidable in the lower C-rail 22 between the blocks 25 of the stops 20. The sensor 9 may be of the noncontacting inductor type and the stop 14 can be a ferrous block or magnet that makes it produce an output in the center frame position. It is also possible to provide two stops or actuators 14 flanking the center position, so that when the sensor 9 cannot detect the presence of either of these actutors 14 or detects them both equally it signals to the controller 17 that the frame 3 is in the center position.

Figure 7:
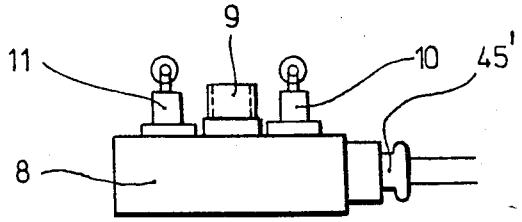
FIG. 7 is a view like FIG. 6 but illustrating another control unit according to the present invention.

These switches 10, 11, 18, and 41 project downstream in the direction D from the holder box 8 and connectors 45 are provided on the upstream box side for the cable 15 (FIG. 1) leading to the controller 17 and a cable 16 to the actuator 6. It is also possible as shown in FIG. 7 to provide a single cable connector 45' projecting laterally from the parallepipedal housing 8.

In this arrangement when the frame 3 pivots into a near end position, thereby tripping the switch 18 or the switch 41, an alarm sounds. This summons a machine operator who normally can correct the positioning problem without shutting down the production line. If this position is passed and one of the far-end positions 10 or 11 is actuated, the controller 17 shuts down the entire line.

The center sensor 9 is mainly used at startup, to ensure that the frame 3 is centered and square on the base 2. The controller 17 can be programmed easily to move in one direction until either the center position is detected, in which case the drive 6 stops, or until a near-end switch 18 or 41 is actuated, in which case the drive 6 reverses and operates until the center position is detected.

Figure 8:
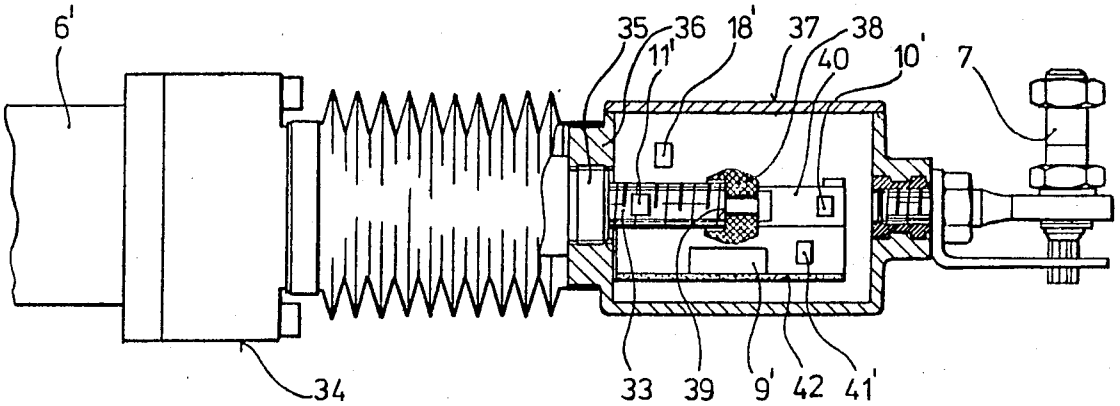
FIGS. 8 and 9 are horizontal and vertical sections through a detail of another apparatus of this invention.
Figure 9:
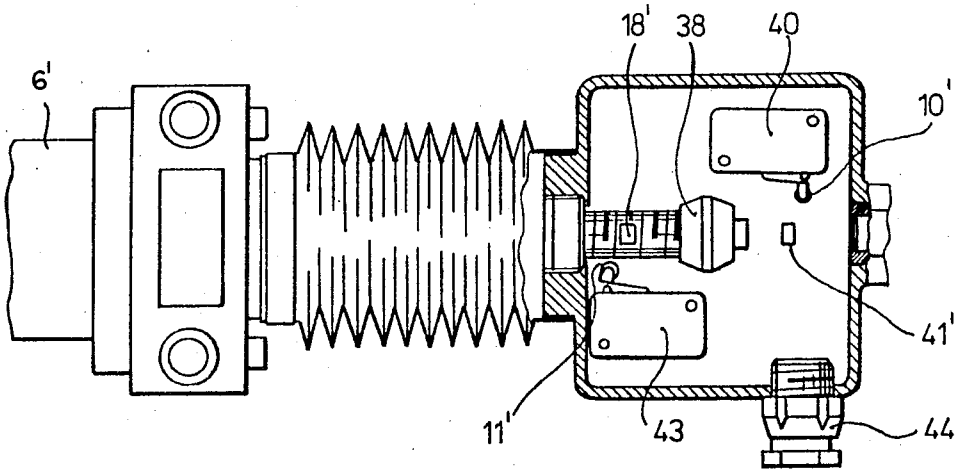

FIGS. 8 and 9 show a similar arrangement wherein the drive is a direct-current motor 6' having an output-side universal joint 34 carrying an output shaft 33 formed as a threaded spindle. The sensor holder here is a box 37 having one end pivoted at 7 on the frame 3 and an opposite end wall 36 provided with a nut 35 into which the spindle 33 is screwed. This spindle 33 has an end 39 in the box provided with a double-conical synthetic-resin switch-actuator element 38 centered on the spindle axis.

In this arrangement the switches 10' and 11' are constituted as microswitches 40 and 43 and lie in a common diametral plane of the spindle 33, but diametrically opposite each other. The switches 18' and 41' are similarly constituted and arranged, but 90° offset from the switches 10' and 11'. These switches 10', 11', 18', and 41', as well as a center-position sensor 9' are all carried on a circuit board 42 inside the holder box 37, which has a cable connection 44 for electrical coupling-up to the controller 17.

The sensor 9' here reacts through the dielectric element 38 with the steel spindle end 39, producing an inductive output having a magnitude directly related to the position of the spindle 33. Since this position corresponds to that of the frame 3 relative to the base 1, it is possible in this manner to detect frame position accurately, in an arrangement easily retrofitted on an existing tilt box.

The system of this invention can therefore be installed on a new or existing tilt-box relatively easily. Whether underneath the frame 3 as in FIGS. 1 through 6 or on the drive as in FIGS. 8 and 9, it takes up very little space. All the position-sensing parts are closely juxtaposed with each other in one location so that they can be worked on together, and will not appreciably interfere with normal servicing of the machine.

We claim:

1. In combination with a tilt-box arrangement for controlling the transverse displacement of a web and having a stationary support frame;

a roller frame pivotal on the support frame about a frame axis and carrying at least one roller rotatable about a roller axis transverse to the frame axis, the web being engaged over the roller and moving in a transport direction transverse to the frame axis and to the roller axis; and a drive connected between the support and roller frames and operable to pivotally displace the roller frame in opposite angular directions from a center position with the roll axis perpendicular to the transport direction toward respective end positions and thereby laterally deflect the web engaged by the roller, the drive including a threaded spindle generally fixed on the support frame and extending transversely of the travel direction and frame axis; and a nut on the spindle and generally fixed on the roller frame, whereby relative rotation of the spindle and nut angularly displaces the roller frame on the support frame;

a control system comprising:

a sensor holder mounted on the support frame and carrying the nut;

two respective end-position sensors and a center-position sensor mounted on the sensor holder;

a stop holder constituted by the spindle;

respective end-position and center-position stops mounted on the stop holder and juxtaposable and cooperating with the sensors generally only in the respective positions of the roller frame on the support frame; and control means connected between the sensors and the drive for operating the drive in accordance with the frame position detected by the sensors.

2. The tilt-box control combination defined in claim 1 wherein the end-position sensors are switches vertically offset from the center-position sensor.

3. The tilt-box control combination defined in claim 1, further comprising a second pair of end-position sensors stops lying just within the first-mentioned pair of end-position sensors and stops on the respective holders.

4. The tilt-box control combination defined in claim 1 wherein the sensor holder is a box containing the sensors, the control means including a cable connected through the box to the sensors.

5. The tilt-box control combination defined in claim 1 wherein the spindle is provided with a switch-actuating element constituting the stops.

6. The tilt-box control combination defined in claim 5 wherein the element is of a synthetic resin and is a symmetrical body of revolution centered on the spindle.

7. The tilt-box control combination defined in claim 1, further comprising a second pair of end-position sensors lying just within the first-mentioned pair of end-position sensors and stops on the sensor holder and vertically offset from the end-position sensors.

* * * * *